US009638207B2

(12) United States Patent
Jayaram et al.

(10) Patent No.: US 9,638,207 B2
(45) Date of Patent: May 2, 2017

(54) CENTRIFUGAL PUMP FOR HANDLING ABRASIVE-LADEN FLUID

(71) Applicant: Summit ESP, LLC, Tulsa, OK (US)

(72) Inventors: Shiv Jayaram, Houston, TX (US); Thomas John Gottschalk, Houston, TX (US); Clint Franklin Hall, Claremore, OK (US); Wesley John Nowitzki, Broken Arrow, OK (US)

(73) Assignee: Summit ESP, LLC, Tulsa, OK (US)

( * ) Notice: Subject to any disclaimer, the term of this patent is extended or adjusted under 35 U.S.C. 154(b) by 0 days.

(21) Appl. No.: 14/865,305

(22) Filed: Sep. 25, 2015

(65) Prior Publication Data

US 2016/0090992 A1 Mar. 31, 2016

(51) Int. Cl.
*F04D 29/22* (2006.01)
*F04D 1/00* (2006.01)
(Continued)

(52) U.S. Cl.
CPC ..... *F04D 29/2238* (2013.01); *E21B 43/128* (2013.01); *F04D 1/00* (2013.01);
(Continued)

(58) Field of Classification Search
CPC ..... F04D 29/66; F04D 29/661; F04D 29/662; F04D 29/286; F04D 29/2238; F04D 29/24; F04D 13/08; G01M 1/36
(Continued)

(56) References Cited

U.S. PATENT DOCUMENTS 1,642,914 A * 9/1927 Whann ..... F04D 29/047 384/132
2,236,953 A 4/1941 Schott
(Continued)

FOREIGN PATENT DOCUMENTS

CN 102606490 A 7/2012

OTHER PUBLICATIONS

Madhwesh, N. K. et al., "Impeller Treatment for a Centrifugal Fan using Splitter Vanes—A CFD Approach," Paper at Proceedings of the World Congress on Engineering 2011 vol. III, Jul. 6-8, 2011, 6 pages, London, England.

*Primary Examiner* — Gregory Anderson
*Assistant Examiner* — Michael Sehn
(74) *Attorney, Agent, or Firm* — Frederic Dorwart, Lawyers; Penina Michlin Chiu

(57) ABSTRACT

A centrifugal pump for handling abrasive-laden fluid is described. A centrifugal pump system for handling abrasive-laden fluid includes an impeller including an annular balance ring extending longitudinally on a top side of the impeller and an annular skirt extending longitudinally on a bottom side of the impeller, one of the annular balance ring, the annular skirt or a combination thereof having portions defining a plurality of apertures, wherein the plurality of apertures form an abrasive-media relief path that bypasses at least a portion of a clearance gap and merges with a primary working-fluid flow path. A centrifugal pump impeller includes a bottom shroud, an annular skirt extending longitudinally upstream from the bottom shroud, the annular skirt encircling a central hub, and the annular skirt having an aperture extending through a thickness of the annular skirt.

24 Claims, 8 Drawing Sheets

(51) Int. Cl.
*F04D 13/08* (2006.01)
*E21B 43/12* (2006.01)
*F04D 29/24* (2006.01)

(52) U.S. Cl.
CPC ..... *F04D 13/08* (2013.01); *F04D 29/2294* (2013.01); *F04D 29/245* (2013.01)

(58) Field of Classification Search
USPC ..... 415/199.1, 199.2
See application file for complete search history.

(56) References Cited

U.S. PATENT DOCUMENTS

| | | | | |
|---|---|---|---|---|
| 4,781,531 | A | 11/1988 | James | |
| 5,722,812 | A | 3/1998 | Knox et al. | |
| 6,106,224 | A * | 8/2000 | Sheth | F04D 29/0413 415/104 |
| 7,549,837 | B2 | 6/2009 | Hackworth et al. | |
| 8,070,426 | B2 | 12/2011 | Brunner et al. | |
| 8,491,277 | B2 | 7/2013 | Kawabata et al. | |
| 8,684,679 | B2 | 4/2014 | Tetzlaff et al. | |
| 9,039,356 | B1 | 5/2015 | Nowitzki et al. | |
| 9,200,642 | B2 | 12/2015 | Nowitzki et al. | |
| 2012/0020777 | A1 | 1/2012 | Eslinger | |
| 2013/0209225 | A1 | 8/2013 | Eslinger | |
| 2013/0319956 | A1 | 12/2013 | Tetzlaff et al. | |
| 2014/0030055 | A1 | 1/2014 | Jayaram et al. | |
| 2015/0152877 | A1 | 6/2015 | Jayaram et al. | |

* cited by examiner

CENTRIFUGAL PUMP FOR HANDLING ABRASIVE-LADEN FLUID

CROSS REFERENCE TO RELATED APPLICATIONS

This application claims the benefit of U.S. Provisional Application No. 62/056,224 to Jayaram et al., filed Sep. 26, 2014 and entitled "CENTRIFUGAL PUMP FOR HANDLING ABRASIVE-LADEN FLUID," which is hereby incorporated by reference in its entirety.

BACKGROUND OF THE INVENTION

1. Field of the Invention

Embodiments of the invention described herein pertain to the field of multi-stage centrifugal pumps. More particularly, but not by way of limitation, one or more embodiments of the invention enable a centrifugal pump for handling abrasive-laden fluid.

2. Description of the Related Art

Fluid, such as gas, oil or water, is often located in underground formations. In such situations, the fluid must be pumped to the surface so that it can be collected, separated, refined, distributed and/or sold. Centrifugal pumps are typically used in electric submersible pump (ESP) applications for lifting well fluid to the surface. Centrifugal pumps impart energy to a fluid by accelerating the fluid through a rotating impeller paired with a stationary diffuser. A rotating shaft runs through the central hub of the impeller and diffuser. A motor upstream of the pump turns the shaft, and the impeller is keyed to the shaft, causing the impeller to rotate with the shaft.

Each rotating impeller and stationary diffuser pair is called a "stage". The impeller's rotation confers angular momentum to the fluid passing through the pump. The angular momentum converts kinetic energy into pressure, thereby raising the pressure on the fluid and lifting it to the surface. Multiple stages of impeller and diffuser pairs may be used to further increase the pressure lift. The stages are stacked in series around the pump's shaft, with each successive impeller sitting on a diffuser of the previous stage.

FIG. 1 illustrates a conventional impeller of the prior art. As shown in FIG. 1, impellers typically have a conventional skirt 100 extending axially on the bottom of the impeller. The conventional skirt 100 wear ring rotates inside the conventional diffuser exit skirt 105. The close conventional clearance 1 between conventional impeller skirt 100 and the conventional diffuser exit skirt 105 provides a hydraulic seal to restrict fluid from leaking back to the eye of the impeller when fluid is pumped. The hydraulic seal helps to increase volumetric efficiency, maintain desired performance and assist with radial stabilization.

During operation of the pump, abrasives such as sand, dirt and other solid particles in the pumped fluid pass through clearance 1 between the conventional impeller skirt 100 and conventional diffuser exit skirt 105, wearing down those pump components. As the skirt wears, the gap increases, fluid and pressure leaks, and the pump performance is reduced. The conventional clearance 1 between conventional impeller skirt 100 and conventional diffuser exit skirt 105 should be between about 0.010 inches and 0.014 inches diametrically (0.005-0.007 inches radially), depending upon the size of the pump. Gaps in excess of about 0.022 inches diametrically cause reduced pump production, which may necessitate that the pump be pulled out of operation.

Impellers also have a conventional balance ring 115 extending axially on the top side of the impeller. Conventional impeller balance ring 115 rotates inside the conventional diffuser inlet 120. There is also a close conventional clearance 2 between conventional impeller balance ring 115 and conventional diffuser inlet 120. During operation of the pump, the hydraulic seal which forms within the space between conventional balance ring 115 and conventional diffuser inlet 120 provides radial support to the pump. Conventional balance holes 125 drilled in the top of the impeller may be included to regulate the downthrust force.

Abrasives in pumped well fluid flow through conventional clearance 2 during pump operation, wearing down the conventional balance ring 115 and conventional diffuser inlet 120. This abrasive wear increases the conventional clearance 2 between the conventional balance ring 115 and conventional diffuser inlet 120, and in such instances, radial support decreases and pump performance degrades. The lack of radial support increases wear. Performance degradation may cause an ESP system to fail because of the lack of lift.

Conventionally, a hard coating such as nickel nitride, has been applied to impeller skirts and balance rings in order to prevent wear from abrasives in well fluid. However, coating an impeller is time consuming and expensive.

As is apparent from the above, current centrifugal pumps are not well-suited to handling abrasives. Therefore, there is a need for a centrifugal pump for handling abrasive-laden fluid.

BRIEF SUMMARY OF THE INVENTION

One or more embodiments of the invention enable a centrifugal pump for handling abrasive-laden fluid.

A centrifugal pump for handling abrasive-laden fluid is described. An illustrative embodiment of a centrifugal pump impeller includes a hub securable to a centrifugal pump shaft, the hub including a tubular portion, a flared portion extending from a downstream side of the tubular portion, a rim of the flared portion forming a platform extending radially from the centrifugal pump shaft, an annular balance ring extending longitudinally downstream from the platform, wherein the annular balance ring has at least one aperture extending through a thickness of the balance ring. In some embodiments, the annular balance ring has a plurality of apertures distributed around the balance ring. In certain embodiments, the platform has at least one pair of balance holes extending longitudinally through the platform and substantially perpendicular to the at least one aperture, wherein the at least one aperture and the at least one pair of balance holes together define a pathway for working fluid. In some embodiments, the centrifugal pump impeller includes a skirt extending longitudinally upstream from a shroud on an upstream side of the tubular portion, the skirt having at least one second aperture extending through a thickness of the skirt. In certain embodiments, the skirt has a plurality of second apertures distributed around the skirt. In some embodiments, the at least one second aperture is slanted downstream in an inward direction. In certain embodiments, the at least one aperture is one of circular or a rounded rectangular slot.

An illustrative embodiment of a centrifugal pump includes a multistage centrifugal pump including a rotatable impeller, the rotatable impeller comprising an annular balance ring extending axially from a top side of the impeller, a diffuser stacked downstream of the impeller, wherein the balance ring extends within an inlet of the diffuser and a clearance gap is formed between the annular balance ring and the inlet, and the annular balance ring having an aperture extending through a wall of the annular balance ring. In some embodiments, the annular balance ring has a series of the apertures distributed around the balance ring. In certain embodiments, the series of apertures forms a pathway that bypasses at least a portion of the clearance gap and merges with a primary working-fluid flow path. In some embodiments, a hub of the rotatable impeller has at least one balance hole extending through the hub, the at least one balance hole substantially perpendicular to the series of apertures. In certain embodiments, the at least one balance hole and the series of apertures together form the pathway. In some embodiments, the centrifugal pump includes an annular impeller skirt extending axially from a bottom side of the impeller, a second diffuser stacked upstream of the impeller, wherein the annular impeller skirt extends within a diffuser exit cavity of the second diffuser and a second clearance gap is formed between the annular impeller skirt and the diffuser exit cavity, and the annular impeller skirt having a second aperture extending through a wall of the annular impeller skirt. In certain embodiments, the second aperture forms a pathway that bypasses at least a portion of the second clearance gap and merges with a primary working-fluid flow path. In some embodiments, the second aperture is slanted through the wall of the annular impeller skirt downstream in an inward direction. In certain embodiments, the annular impeller skirt has a plurality of the second apertures distributed around the annular impeller skirt.

An illustrative embodiment of a centrifugal pump system for handling abrasive-laden fluid includes an impeller comprising an annular balance ring extending longitudinally on a top side of the impeller and an annular skirt extending longitudinally on a bottom side of the impeller, one of the annular balance ring, the annular skirt or a combination thereof having portions defining a plurality of apertures, wherein the plurality of apertures form an abrasive-media relief path that bypasses at least a portion of a clearance gap and merges with a primary working-fluid flow path. In some embodiments, the abrasive-media relief path is formed from at least one aperture of the plurality of apertures and a balance hole. In certain embodiments, the balance hole extends perpendicularly to the at least one aperture. In some embodiments, the clearance gap is an area of tight design clearance between the impeller and a diffuser, wherein the tight design clearance is less than about 0.022 inches diametrically.

An illustrative embodiment of a centrifugal pump impeller includes a bottom shroud, an annular skirt extending longitudinally upstream from the bottom shroud, the annular skirt encircling a central hub, the annular skirt having an aperture extending through a thickness of the annular skirt. In some embodiments, the aperture is slanted downstream in an inward direction through the thickness of the annular skirt. In certain embodiments, the annular skirt has a series of the apertures distributed around the annular skirt.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

Advantages of the present invention may become apparent to those skilled in the art with the benefit of the following detailed description and upon reference to the accompanying drawings in which.

Figure 1:
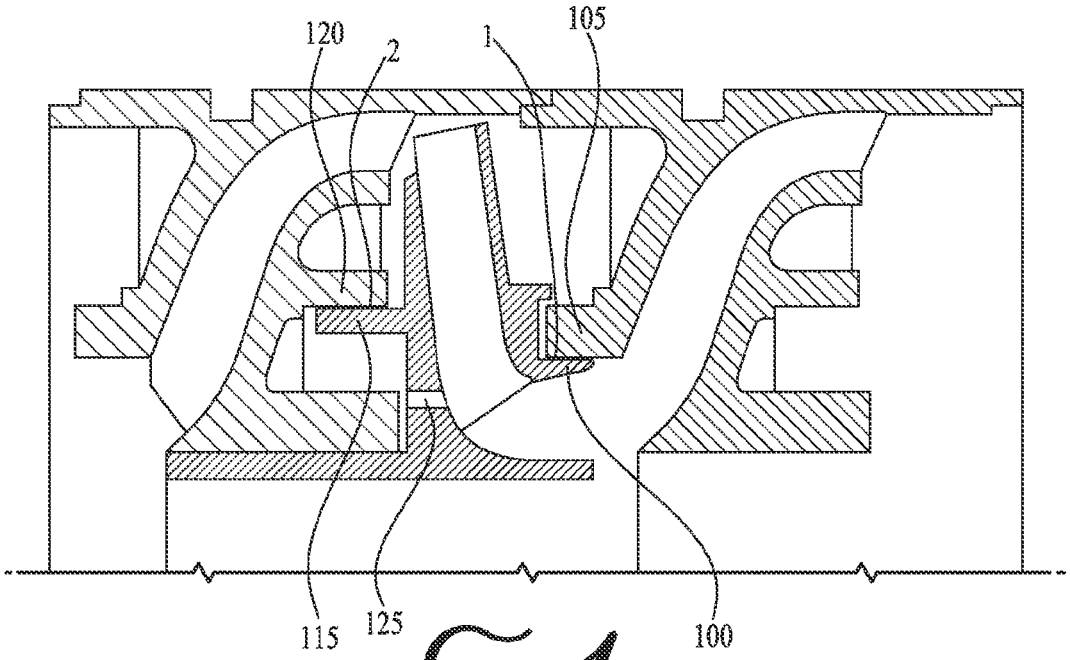
FIG. 1 PRIOR ART
FIG. 1 is a cross-sectional view of a centrifugal pump stage of the prior art.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives falling within the scope of the present invention as defined by the appended claims.

DETAILED DESCRIPTION

A centrifugal pump for handling abrasive-laden fluid will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to an aperture includes one or more apertures.

"Coupled" refers to either a direct connection or an indirect connection (e.g., at least one intervening connection) between one or more objects or components. The phrase "directly attached" means a direct connection between objects or components.

As used herein, the term "outer," "outside" or "outward" means the radial direction away from the center of the shaft of the centrifugal pump and/or the opening of a component through which the shaft would extend. As used herein, the term "inner", "inside" or "inward" means the radial direction toward the center of the shaft of the centrifugal pump and/or the opening of a component through which the shaft would extend. As used herein the terms "axial", "axially", "longitudinal" and "longitudinally" refer interchangeably to the direction extending along the length of the shaft of a centrifugal pump.

As used herein, a "closed" impeller means that there is a shroud on both the top and bottom sides of the impeller. An "open" impeller means that the impeller includes only one or no shroud. As used herein, the "top" of the impeller refers to the balance ring side of the impeller facing downstream and the "bottom" of the impeller refers to the skirt side of the impeller facing upstream, without regard to the orientation of the impeller in space.

"Downstream" refers to the direction substantially with the principal flow of working fluid when the pump assembly is in operation. By way of example but not limitation, in a vertical downhole electric submersible pump (ESP) assembly, the downstream direction may be towards the surface of the well.

"Upstream" refers to the direction substantially opposite the principal flow of working fluid when the pump assembly is in operation. By way of example but not limitation, in a vertical downhole ESP assembly, the upstream direction may be opposite the surface of the well.

As used in this specification and the appended claims, the terms "media", "abrasive media" "solids", "laden well fluid," "foreign solids," "abrasives" and "contaminants" refer interchangeably to sand, rocks, rock particles, soils, slurries, and any other non-liquid, non-gaseous matter found in the fluid being pumped by an artificial lift pumping system.

One or more embodiments of the invention provide a centrifugal pump for handling abrasive-laden fluid. While for ease of illustration illustrative embodiments are described in terms of an oil or gas downhole pumping embodiment, nothing herein is intended to limit the invention to that embodiment.

An illustrative embodiment of an abrasive handling impeller for a multistage centrifugal pump includes apertures dispersed circumferentially around the impeller balance ring, and in some embodiments, the impeller skirt. The apertures may provide multiple relief paths for abrasive media in areas of tight design clearance, for example the hydraulic clearance gaps between the pump impeller and diffusers. The combination of relief paths and pressure differential created by the apertures may cause solid-laden fluid to flow from higher pressure areas—such as the clearance-confined hydraulic gaps—out to lower pressure, faster flow areas provided by the apertures. Abrasive media may therefore move away from hydraulic clearance gaps before significant performance-limiting erosion occurs.

Using a centrifugal pump of an illustrative embodiment, abrasive media carried by working fluid may be diverted through the apertures rather than passing through hydraulic gaps in the pump stages. Reducing the quantity of and/or rate that abrasive media comes into contact with the impeller and diffuser surfaces defining hydraulic gaps, may preserve the tight clearances, and thereby may extend the life of the pump, reduce thrust load on the pump's bearing set and increase pump production efficiency. Illustrative embodiments may facilitate the handling of abrasive materials and redirect them before they are able to cause significant abrasive wear to the centrifugal pump.

Figure 2:
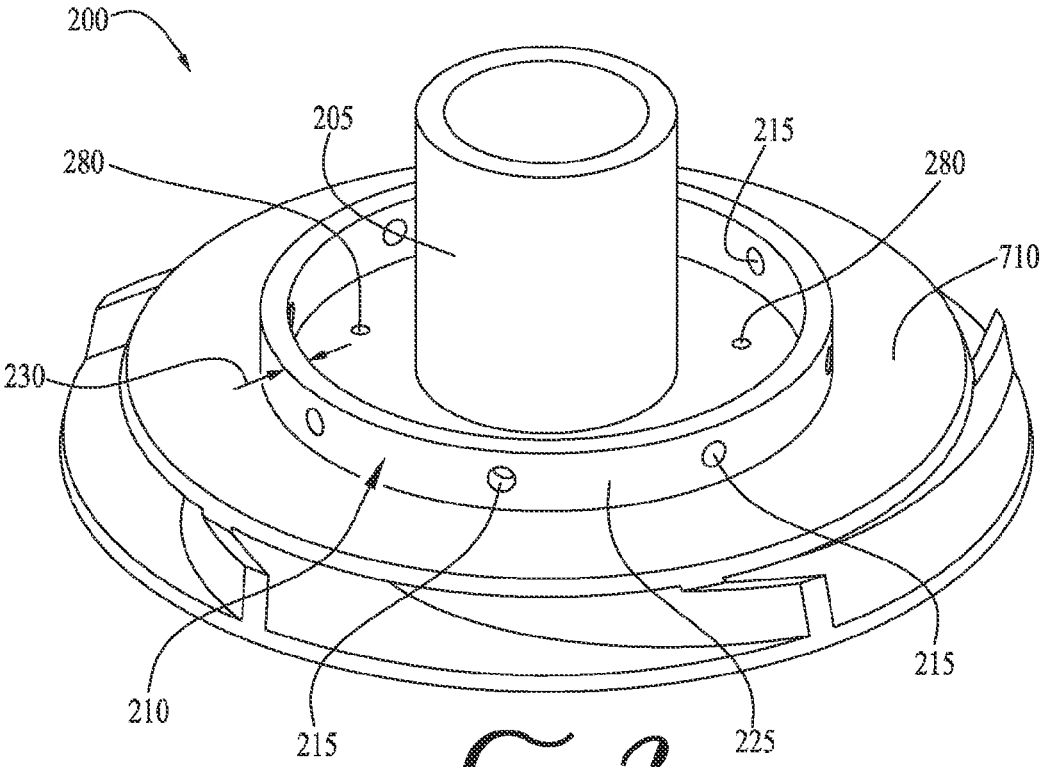
FIG. 2 is a perspective view of a closed impeller of an illustrative embodiment.
Figure 3:
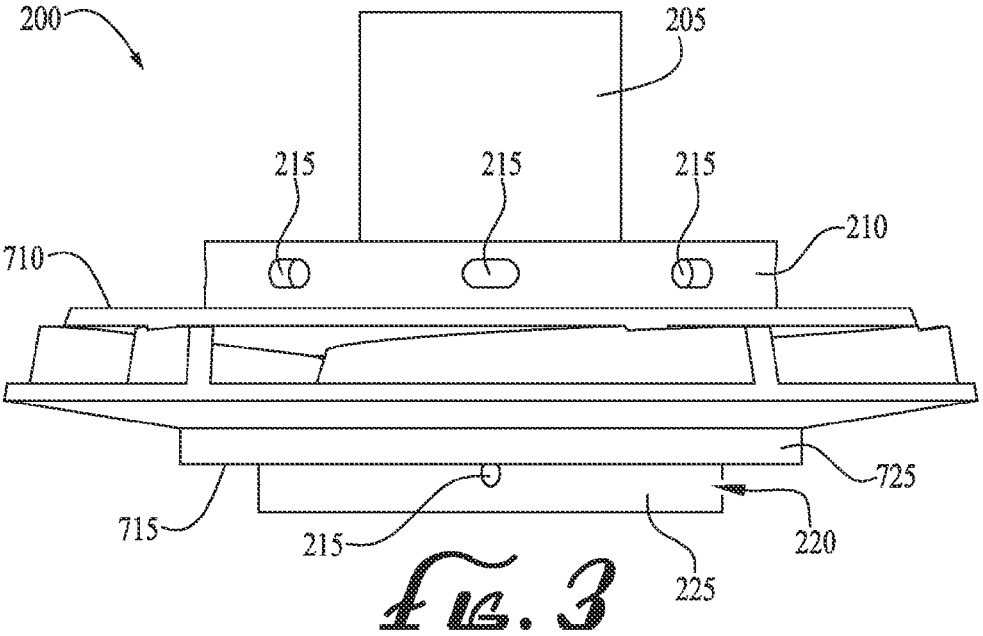
FIG. 3 is a perspective side view of a closed impeller of an illustrative embodiment.
Figure 4:
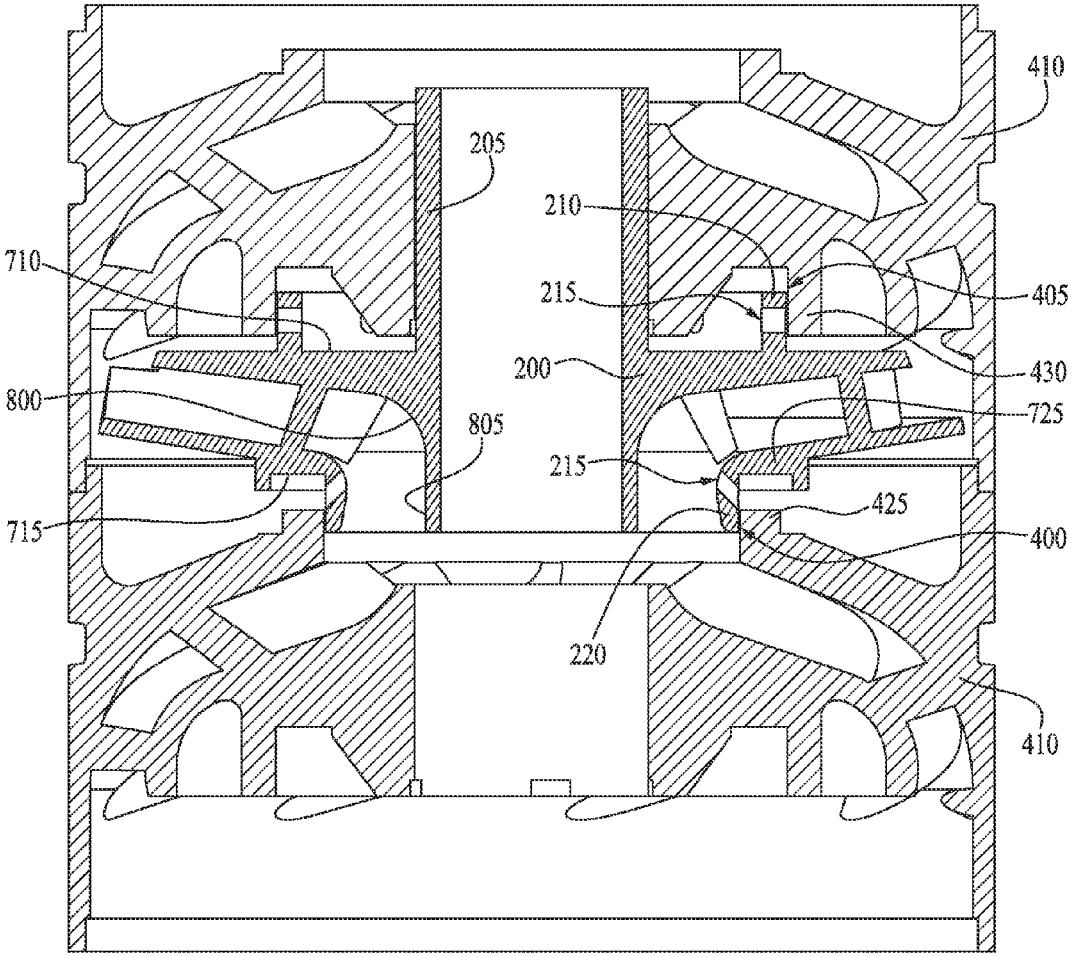
FIG. 4 is a cross sectional view of a centrifugal pump stage of an illustrative embodiment with an exemplary closed impeller.
Figure 6A:
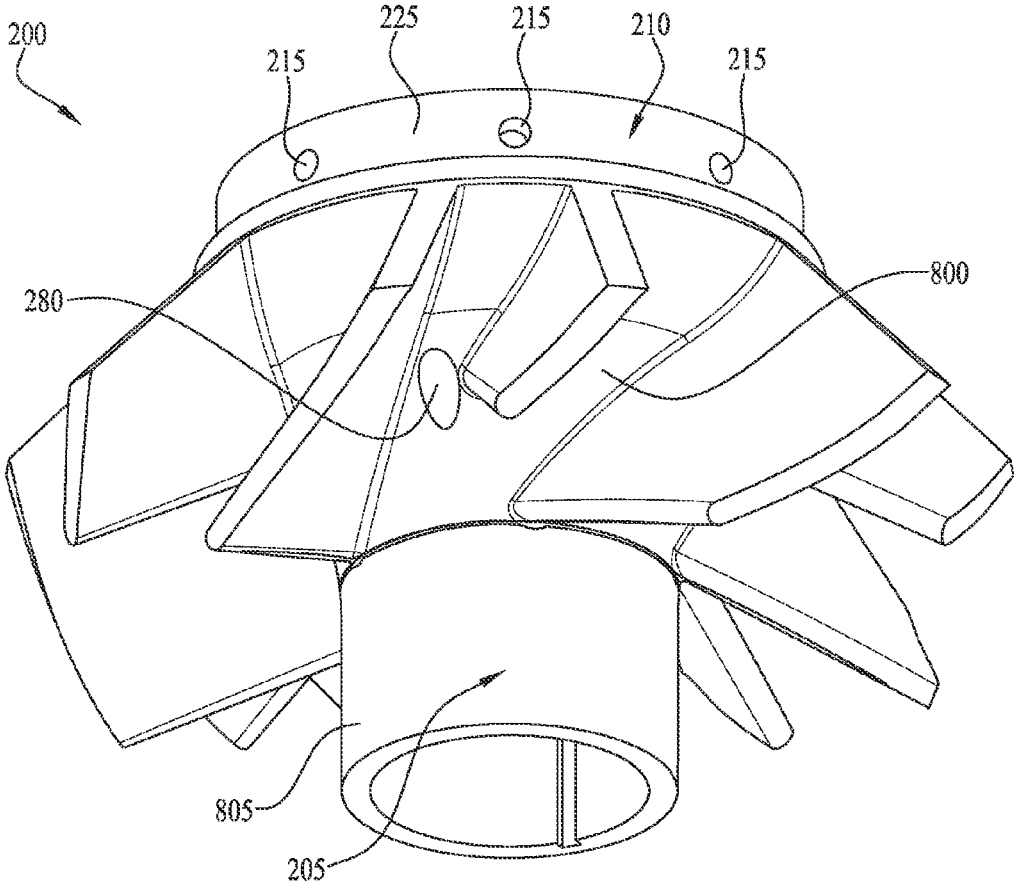
FIG. 6A is a perspective view of an open impeller of an illustrative embodiment.
Figure 6B:
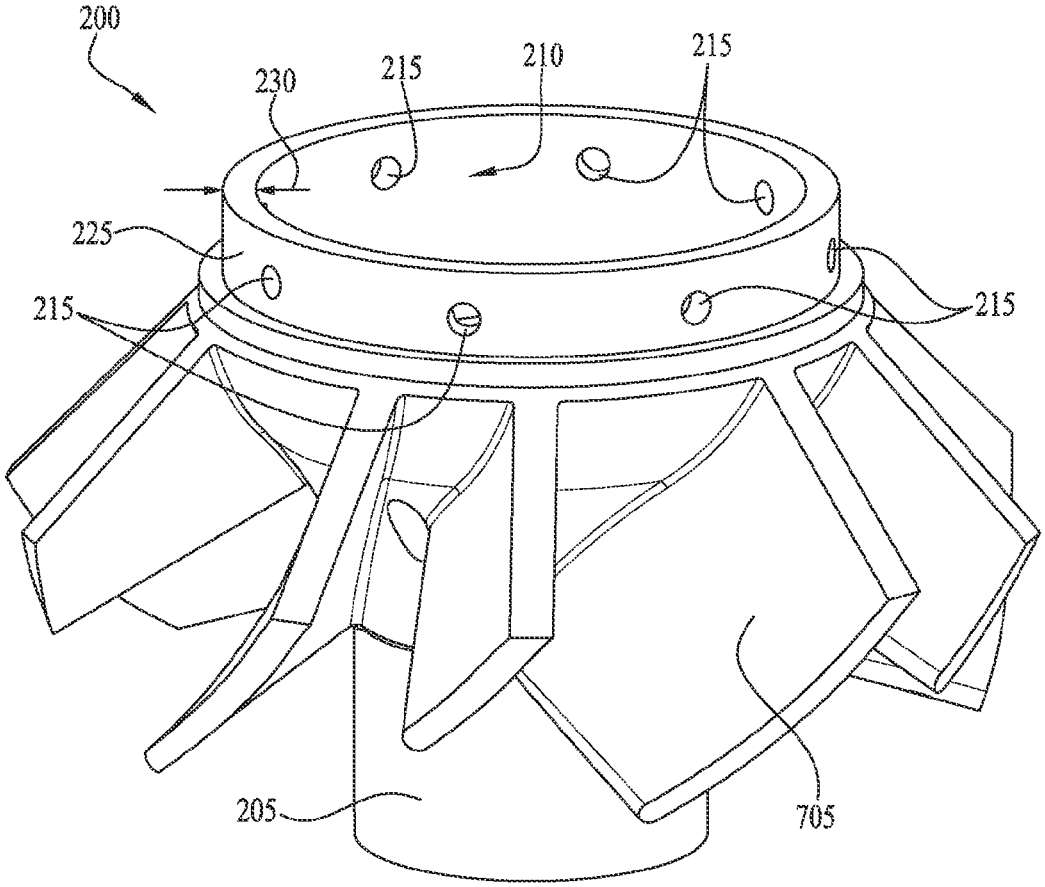
FIG. 6B is a perspective view of an open impeller of an illustrative embodiment.
Figure 7:
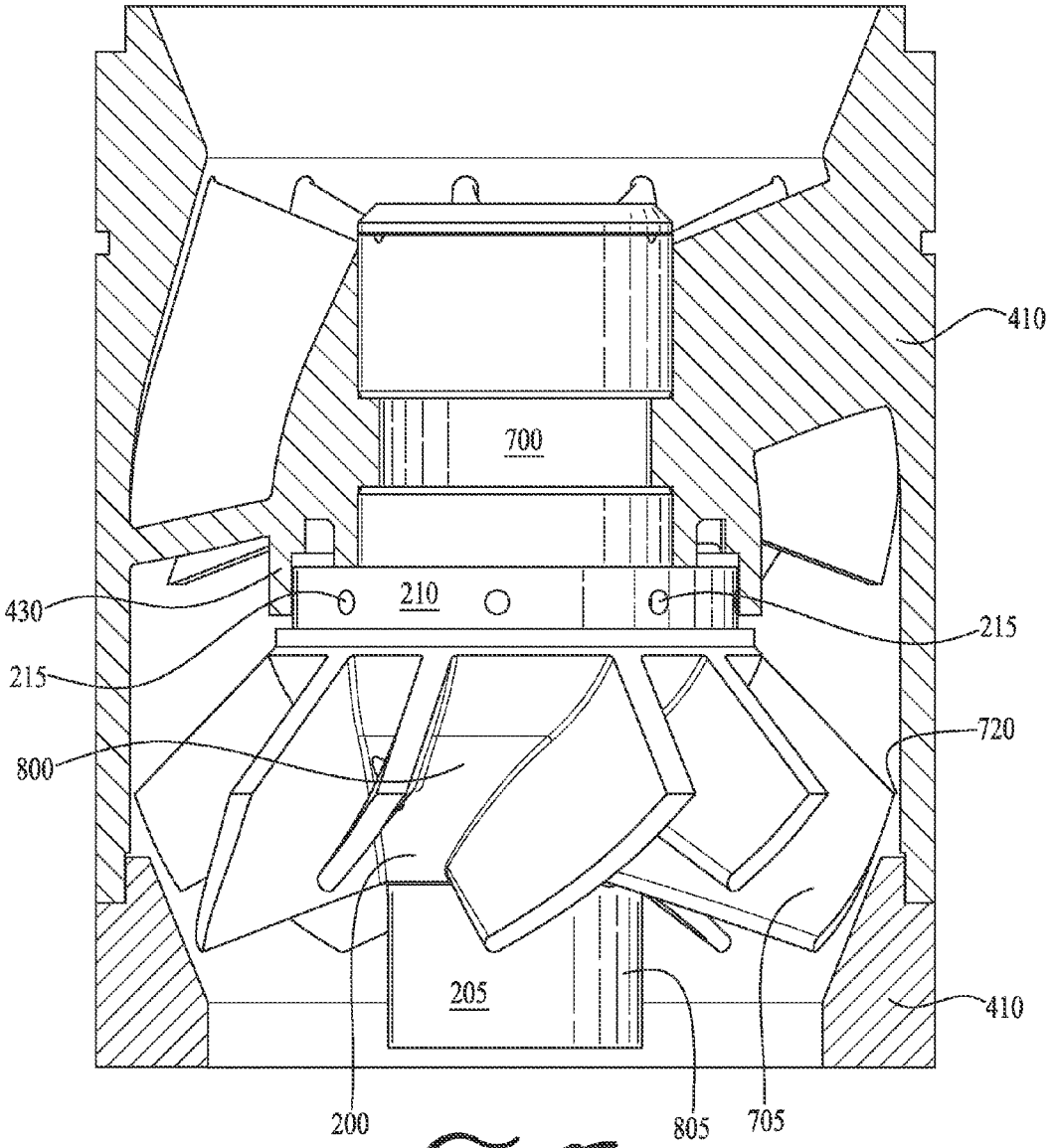
FIG. 7 is a cross sectional view of a centrifugal pump stage of an illustrative embodiment with an exemplary open impeller.

The impeller of illustrative embodiments may be an open or closed impeller. The type of impeller employed may depend upon the diameter of the pump and the type of fluid being pumped. For example, the amount of gas or suspended solids in working fluid may be a factor in determining whether an open or closed impeller is employed in the centrifugal pump of illustrative embodiments. FIGS. 2 and 3 show an exemplary closed impeller of an illustrative embodiment, with FIG. 4 illustrating a stage of an illustrative embodiment having a closed impeller. FIGS. 6A and 6B illustrate an exemplary open impeller of an illustrative embodiment, with FIG. 7 illustrating a stage of an illustrative embodiment having an open impeller. Impeller 200 may be an impeller of a multi-stage centrifugal pump for use in downhole pumping applications. Impeller 200 includes hub 205, through which pump shaft 700 (shown in FIG. 7) would extend. Hub 205 may extend tubularly (cylindrically) around shaft 700, and may be keyed, friction fit or otherwise attached to shaft 700, such that it rotates with shaft 700 during operation of the pump. The inner diameter of hub 205 may hug shaft 700 for the length of hub 205. The outer diameter of hub 205 may include tubular portion 805 and flared portion 800. Flared portion 800 may flare in the fashion of a trumpet and/or bell on the downstream side of tubular portion 805. The downstream side of flared portion 800 may include a radially extending rim that forms hub platform 710 arranged perpendicularly to shaft 700. Balance holes 280 may extend through hub platform 710 of hub 205 in generally a longitudinal direction and may assist in regulating downthrust force.

Balance ring 210 may be an annular extension (circular wall) of hub 205 that extends axially from hub platform 710, encircling shaft 700 in a ring-like fashion. FIG. 2 and FIG. 6A illustrate balance ring 210 of illustrative embodiments. Balance ring 210 may be a seal and/or wear ring that restricts (chokes) fluid flow to assist in preventing higher pressure fluid from impeller 200 discharge from recirculating back to the lower pressure impeller 200 intake area, and instead proceed downstream through the downstream diffuser 410. Balance ring 210 may also dampen radial vibrations imparted by shaft 700 and/or impeller 200 imbalance so that shaft 700 deflection is minimized. This stiffening is known in the art as the Lomakin effect. Balance ring 210 may be closely received within diffuser inlet 430 (shown in FIG. 4) of diffuser 410 of the same stage as impeller 200. Balance ring 210 may be taller than it is in thickness 230. In illustrative embodiments, balance ring 210 may be defined by two concentric cylinders and about ⅛ inch or ¼ inch tall (axial direction) and about ⅛ inch or ¼ inches in thickness 230 (radial direction).

Skirt 220 may be included in closed impeller embodiments, for example as illustrated in FIGS. 2 and 3, and may be a wear ring on the upstream side of impeller 200. In embodiments where impeller 200 includes a bottom shroud 725, skirt 220 may be an annular extension (circular wall) of shroud 725, extending axially from shroud platform 715 of shroud 725 and encircling shaft 700 on the upstream side of impeller 200. During pump operation, skirt 220 may rotate within cavity 425 (shown in FIG. 4) of diffuser 410 of the previous stage as impeller 200. Similarly to balance ring 210, skirt 220 may assist in dampening radial vibrations imparted by shaft 700 and stiffening.

Balance ring 210 and/or skirt 220 may include one or more apertures 215. In some embodiments, only a single aperture 215 may be necessary. In certain embodiments, apertures 215 may be evenly distributed around balance ring 210 and/or skirt 220. Apertures 215 may be arranged in one or more rows and may be drilled, cast or machined entirely through balance ring 210 and/or skirt 220. In certain embodiments, apertures 215 extend radially—substantially parallel to platforms 710, 715 and/or perpendicular to shaft 700. In some embodiments, apertures 215 may extend slantedly through thickness 230 of balancing ring 210 and/or skirt 220. In exemplary embodiments, one, four, five, six, eight or ten apertures 215 may be distributed around balance ring 210 and/or skirt 220. For example, six apertures 215 may be arranged around balance ring 210 and eight apertures 215 may be dispersed about skirt 220. In other embodiments, four apertures 215 may be dispersed about balance ring 210 and four apertures 215 may be dispersed about skirt 220. Apertures 215 may be placed at or about midway along the height of balance ring 210 and/or skirt 220. In some embodiments, apertures 215 may be shifted more towards the top or bottom of wall 225. In certain embodiments, only one of skirt 220 or balance ring 210 may be included in impeller 200 and/or include apertures 215. In one or more illustrative embodiments including balance holes 280, apertures 215 in balance ring 210 may be oriented perpendicularly to balance holes 280.

The size of apertures 215 may depend on the type of centrifugal pump and impeller employed. In some embodiments each aperture 215 may be 0.09 inches, 0.12 inches or 0.18 inches in diameter. Because impeller 200 rotates, it may be beneficial for apertures 215 to be uniformly sized and to be evenly distributed such that balance ring 210 and/or skirt 220 are symmetric circumferentially. Apertures 215 may be circular in shape as shown in FIG. 2, or may be square, rectangular, or oval slots or a combination thereof. For example, rounded, rectangular shaped slots are shown in the embodiment of balance ring 210 illustrated in FIG. 3. Apertures 215 with a circular cross-sectional shape may be simplest to manufacture in embodiments where apertures 215 are drilled. Apertures 215 of other shapes may be tooled or machined. Various sizes, shapes and number of apertures 215 are contemplated herein.

Apertures 215 may extend straight through wall 225 of balance ring 210 and/or skirt 220, oriented perpendicularly to shaft 700. In certain embodiments, apertures 215 may be angled downstream from the outside to the inside of wall 225. Slanting apertures 215 through wall 225 of balance ring 210 and/or skirt 220 may cause apertures 215 to be more closely aligned with the direction of fluid flowing through the mouth of impeller 200. This slanting may also reduce erosion due to fluid eddies as the stream passing through the clearance gaps 400, 405 (hydraulic portion 505 shown in FIG. 5) and the stream passing through the apertures 215 (media pathway 500 shown in FIG. 5) merge. Angling apertures 215 may aid in drilling apertures 215 by keeping the chuck used to hold the drill bit away from impeller 200 during the manufacturing or rework process. Angled (slanted) apertures may also be accomplished through tooling.

FIG. 4 is a cross sectional view of a centrifugal pump of an illustrative embodiment. As shown in FIG. 4, impeller 200 has a first diffuser 410 on its bottom side that is part of the previous stage, and a second diffuser 410 on a top side that is part of same stage. First clearance 400 may be formed between the outer diameter of skirt 220 and the inner diameter of the portion defining diffuser exit cavity 425 of diffuser 410 of the previous stage. Second clearance 405 may be formed between the outer diameter of balance ring 210 and the inner diameter of the portion defining diffuser inlet 430 of diffuser 410 of the same stage as impeller 200.

During operation of the centrifugal pump, impeller 200 may rotate within diffusers 410. As fluid is lifted through the pump, at least a portion of abrasives carried by working fluid may be directed through apertures 215 rather than through first clearance 400 and/or second clearance 405. Apertures 215 may be placed such that media (abrasives) passing through apertures 215 may entirely bypass or bypass at least a portion of first clearance 400 and/or second clearance 405. As shown in FIG. 4, bypassed second clearance 405 is above (longitudinally downstream of) aperture 215 in balance ring 210, and bypassed first clearance 400 is below (longitudinally upstream of) aperture 215 in skirt 220. In this fashion, a reduced amount of abrasive particles may pass through first clearance 400 and/or second clearance 405, instead passing through apertures 215 and/or remaining in primary fluid path 510 (shown in FIG. 5) of working fluid. This may maintain the tightness of the clearances 400, 405 for an increased duration, which may thereby increase the life of the pump and may improve the efficiency of the pump's operation for an increased amount of time as compared to a pump having an impeller without apertures 215 of illustrative embodiments.

Figure 5:
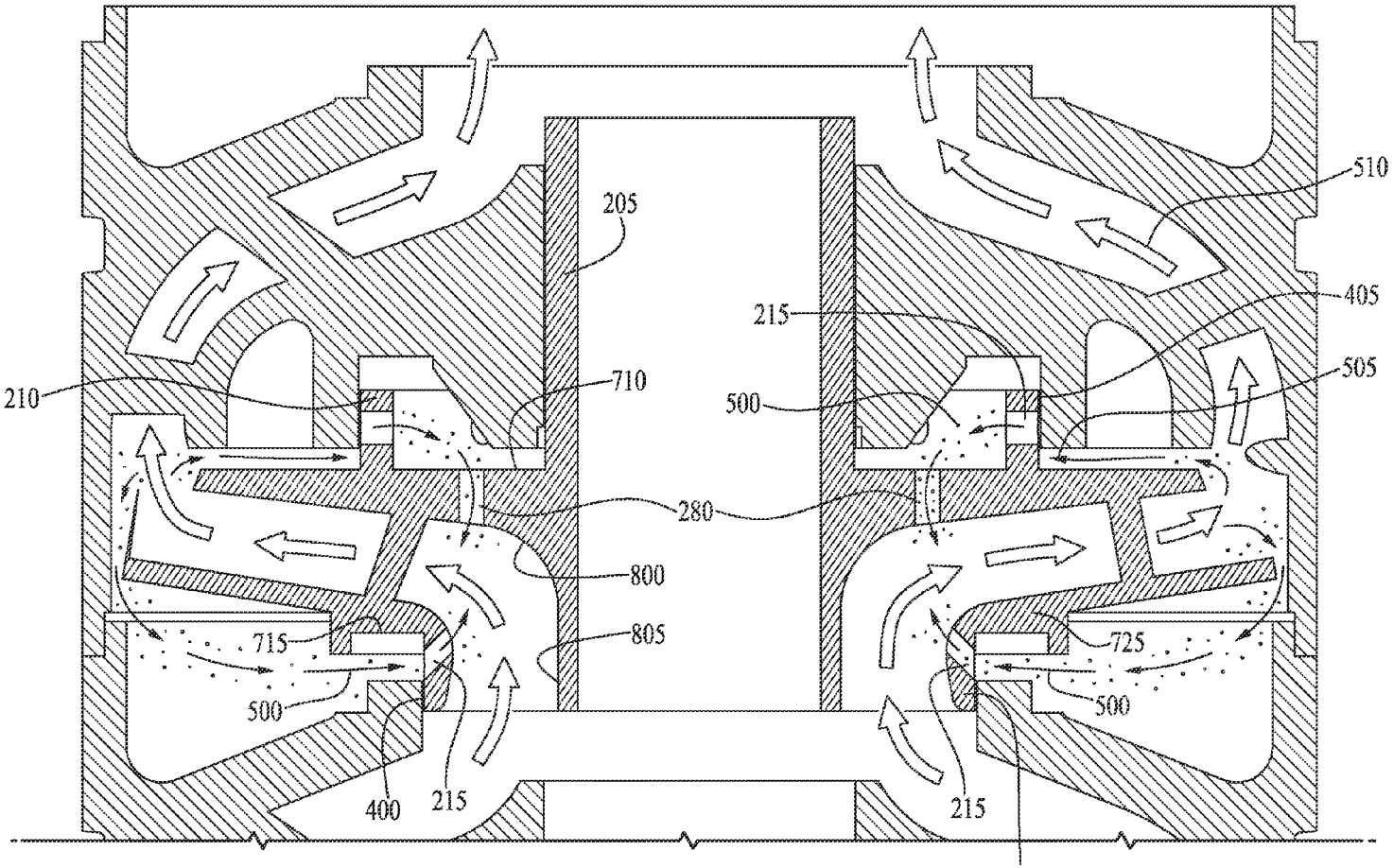
FIG. 5 is a schematic diagram of a fluid flow simulation through a closed impeller of an illustrative embodiment.

FIG. 5 illustrates exemplary fluid flow through a centrifugal pump of an illustrative embodiment including a closed impeller. A small (relative to primary fluid path) hydraulic portion 505 of pumped fluid may continue to flow through clearances 400, 405 in order to provide the hydraulic/hydrodynamic properties afforded by those clearances. In some embodiments, hydraulic portion 505 of fluid flowing through clearances 400, 405 includes a lower concentration of abrasive media that would otherwise flow in the absence of apertures 215. Illustrative embodiments may distribute working fluid and the abrasive media it may contain through primary fluid path 510, abrasive media through abrasive media pathway 500 including apertures 215, and hydraulic portion 505 through first clearance 400 and/or second clearance 405, thereby reducing the quantity and/or frequency that abrasive media passes through any one clearance or aperture. This may reduce the rate and/or extent of abrasive wear to clearances 400, 405 without additional thrust load on the pump's abrasion resistant bearing set.

In some embodiments, media may pass through apertures 215 to join primary fluid path 510. Rotation of impeller 200 and/or movement of fluid through the centrifugal pump, may cause at least a portion of denser, solid particles such as abrasive media, to pass through apertures 215, and the majority portion of pumped fluid (liquid and/or gas) to pass through primary fluid path 510.

As shown in FIG. 5, lower pressure, faster moving abrasive media may pass through apertures 215 in skirt 220 and/or balance ring 210 and then rejoin the primary fluid path 510. In FIG. 5, apertures 215 in skirt 220 are shown angled so as to guide abrasive media following abrasive media pathway 500 into primary fluid path 510. As illustrated in FIG. 5, apertures 215 in skirt 220 are angled upwards as they extend inward. Apertures 215 in balance ring 210 are shown straight, extending radially through wall 225 of balance ring 210 and extending perpendicular to shaft 700. Higher pressure, slower moving fluid may be lifted through primary fluid path 510. Hydraulic portion 505, which may contain lesser concentrations of abrasive media, may continue to lubricate first clearance gap 400 and/or second clearance gap 405. As illustrated in FIG. 5, hydraulic portion 505 and/or abrasives following media pathway 500 may pass through balance holes 280 before merging with primary fluid path 510.

Figure 8:
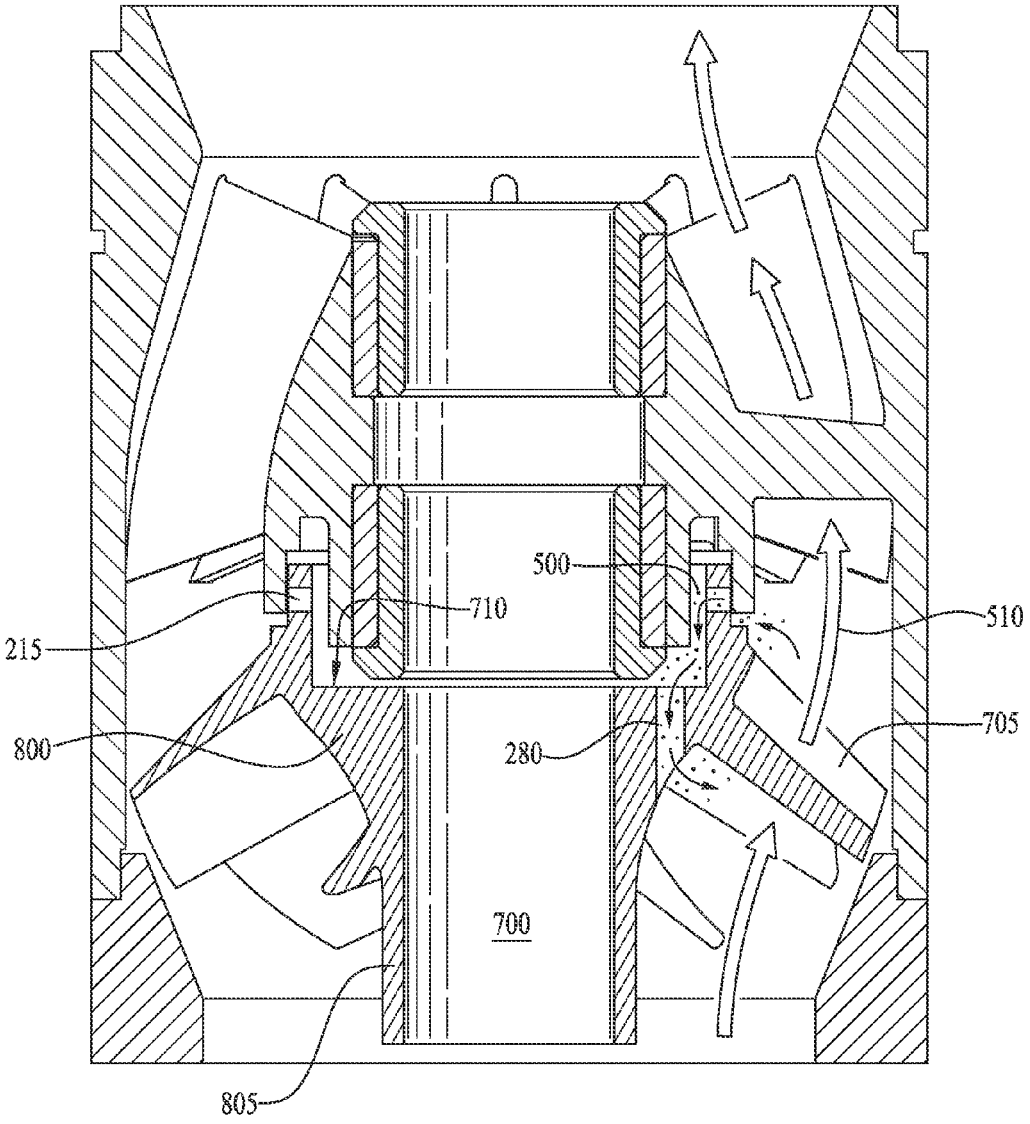
FIG. 8 is a schematic diagram of a fluid flow simulation through an open impeller of an illustrative embodiment.

FIG. 7 illustrates an exemplary embodiment of an open stage. As shown in FIG. 7, although impeller 200 only includes balance ring 210, and no skirt 220, such an open impeller 200 may benefit from apertures 215 of illustrative embodiments. In addition to diverting abrasive media from second clearance 405, erosive wear to the tips of the open vanes 705 may also be reduced using illustrative embodiments, which erosive wear may otherwise increase space 720 between vanes 705 and diffuser 410. Erosion between vanes 705 and diffuser 410 may lead to more recirculation, and lower efficiency and head production per stage. As illustrated in FIG. 8, apertures 215 of illustrative embodiments may redirect abrasive media through those apertures 215 in open stages which may reduce erosion in space 720 and/or reduce erosion through second clearance 405.

Illustrative embodiments may reduce abrasive wear to tight clearances 400, 405 and/or space 720 by directing abrasive media in working fluid through apertures 215 and into primary fluid path 510 rather than through the clearances 400, 405 and space 720. In this way, pump efficiency and longevity may be increased.

Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. A centrifugal pump impeller comprising:

a hub securable to a centrifugal pump shaft, the hub comprising:

a tubular portion;

a flared portion extending from a downstream side of the tubular portion;

a rim of the flared portion forming a platform extending radially from the centrifugal pump shaft;

an annular balance ring extending longitudinally downstream from the platform, wherein the annular balance ring has at least one first aperture extending through a thickness of the balance ring, and a skirt extending longitudinally upstream from a shroud on an upstream side of the tubular portion, the skirt having at least one second aperture extending through a thickness of the skirt.

2. The centrifugal pump impeller of claim 1, wherein the annular balance ring has a plurality of first apertures distributed around the balance ring.

3. The centrifugal pump impeller of claim 1, wherein the platform has at least one pair of balance holes extending longitudinally through the platform and substantially perpendicular to the at least one first aperture, wherein the at least one first aperture and the at least one pair of balance holes together define a pathway for working fluid.

4. The centrifugal pump impeller of claim 1, wherein the skirt has a plurality of second apertures distributed around the skirt.

5. The centrifugal pump impeller of claim 1, wherein the at least one second aperture is slanted downstream in an inward direction.

6. The centrifugal pump impeller of claim 1, wherein the at least one first aperture is one of circular or a rounded rectangular slot.

7. A centrifugal pump comprising:

a multistage centrifugal pump comprising:

a rotatable impeller, the rotatable impeller comprising an annular balance ring extending axially from a top side of the impeller;

a diffuser stacked downstream of the impeller, wherein the balance ring extends within an inlet of the diffuser and a clearance gap is formed between the annular balance ring and the inlet; and the annular balance ring having an aperture extending through a wall of the annular balance ring.

8. The centrifugal pump of claim 7, wherein the annular balance ring has a series of the apertures distributed around the balance ring.

9. The centrifugal pump of claim 8, wherein the series of apertures forms a pathway that bypasses at least a portion of the clearance gap and merges with a primary working-fluid flow path.

10. The centrifugal pump of claim 9, further comprising a hub of the rotatable impeller having at least one balance hole extending through the hub, the at least one balance hole substantially perpendicular to the series of apertures.

11. The centrifugal pump of claim 10, wherein the at least one balance hole and the series of apertures together form the pathway.

12. The centrifugal pump of claim 7, further comprising:

an annular impeller skirt extending axially from a bottom side of the impeller;

a second diffuser stacked upstream of the impeller, wherein the annular impeller skirt extends within a diffuser exit cavity of the second diffuser and a second clearance gap is formed between the annular impeller skirt and the diffuser exit cavity; and the annular impeller skirt having a second aperture extending through a wall of the annular impeller skirt.

13. The centrifugal pump of claim 12, wherein the second aperture forms a pathway that bypasses at least a portion of the second clearance gap and merges with a primary working-fluid flow path.

14. The centrifugal pump of claim 12, wherein the second aperture is slanted through the wall of the annular impeller skirt downstream in an inward direction.

15. The centrifugal pump of claim 14, wherein the second aperture is one of round or a rounded rectangle.

16. The centrifugal pump of claim 12, wherein the annular impeller skirt has a plurality of the second apertures distributed around the annular impeller skirt.

17. A centrifugal pump system for handling abrasive-laden fluid comprising:

an impeller comprising an annular balance ring extending longitudinally on a top side of the impeller and an annular skirt extending longitudinally on a bottom side of the impeller;

one of the annular balance ring, the annular skirt or a combination thereof having portions defining a plurality of apertures, wherein the plurality of apertures form an abrasive-media relief path that bypasses at least a portion of a clearance gap and merges with a primary working-fluid flow path.

18. The centrifugal pump system of claim 17, wherein at least one aperture of the plurality of apertures slants downstream in an inward direction through the annular skirt.

19. The centrifugal pump system of claim 17, wherein the abrasive-media relief path is formed from at least one aperture of the plurality of apertures and a balance hole.

20. The centrifugal pump system of claim 19, wherein the balance hole extends perpendicularly to the at least one aperture.

21. The centrifugal pump system of claim 17, wherein the clearance gap is an area of tight design clearance between the impeller and a diffuser, wherein the tight design clearance is less than about 0.022 inches diametrically.

22. A centrifugal pump impeller comprising:

a bottom shroud;

an annular skirt extending longitudinally upstream from the bottom shroud, the annular skirt encircling a central hub;

the annular skirt having an aperture extending through a thickness of the annular skirt.

23. The centrifugal pump impeller of claim 22, wherein the aperture is slanted downstream in an inward direction through the thickness of the annular skirt.

24. The centrifugal pump impeller of claim 22, wherein the annular skirt has a series of the apertures distributed around the annular skirt.

* * * * *